United States Patent [19]

Frillici et al.

[11] 4,445,688

[45] May 1, 1984

[54] BOWLING PIN HAVING AN IONOMER RESIN CLADDING

[75] Inventors: Fernando V. Frillici, Fairfield, Conn.; Joseph R. Infantino, Chappaqua, N.Y.

[73] Assignee: AMF Incorporated, White Plains, N.Y.

[21] Appl. No.: 893,369

[22] Filed: Apr. 4, 1978

[51] Int. Cl.[3] ..... A63D 9/00

[52] U.S. Cl. ..... 273/82 R; 273/DIG. 22

[58] Field of Search ..... 273/82 R, 82 A, DIG. 4, 273/218, 235, 63 R

[56] References Cited

U.S. PATENT DOCUMENTS

| | | | |
|---|---|---|---|
| 2,787,024 | 4/1957 | Smith | 273/235 R X |
| 3,248,115 | 4/1966 | Conklin et al. | 273/82 R |
| 3,367,656 | 2/1968 | Medney | 273/82 R |
| 3,384,612 | 5/1968 | Brandt et al. | 273/235 R X |
| 3,404,885 | 10/1968 | Smith | 273/82 R |
| 3,421,766 | 1/1969 | Chmiel et al. | 273/235 R X |
| 3,520,969 | 7/1970 | Smith | 273/82 R X |
| 3,819,768 | 6/1974 | Molitor | 273/235 R X |
| 3,940,146 | 2/1976 | Little | 273/235 R |

OTHER PUBLICATIONS

"Modern Plastics Encyclopedia", Sep. 1967, pp. 119 and 120.

"Modern Plastics Encyclopedia", Oct. 1976, pp. 32 and 33.

*Primary Examiner*—Richard J. Apley

*Attorney, Agent, or Firm*—Scully, Scott, Murphy & Presser

[57] ABSTRACT

A bowling pin having a preformed wood body core is provided with an ionomer resin cladding.

10 Claims, 4 Drawing Figures

BOWLING PIN HAVING AN IONOMER RESIN CLADDING

BACKGROUND OF THE INVENTION

1. Field of the Invention

This invention relates to bowling pins and, more particularly, to an improved bowling pin having a wood body core clad with an ionomer resin.

2. Description of the Prior Art

Plastic-coated bowling pins are well known and in their most general form, comprise a wood core to which the plastic coating material is applied employing any one of several known and conventional techniques. For example, successive layers of coating material can be deposited upon the core from a solvent solution until a coating of the desired thickness is obtained. In another procedure, a thermoplastic coating material can be cast or injection molded directly over the core. Thermoplastic coating material can also be applied to the core by the process of rotary thermoforming.

U.S. Pat. No. 3,404,885 to Richard A. Smith (AMF Incorporated) discloses a bowling pin having a core of wood or other suitable material clad with a copolymer of caprolactam and an alkyl ester of acrylic acid and, optionally, a moisture cured polyurethane topcoat for added soil repellency and/or intensity of color. The plastic-coated wood core bowling pin of U.S. Pat. No. 3,520,969 to Richard A. Smith (AMF Incorporated) utilizes as the coating material a polyurethane prepared from the reaction of a polyol and a polyisocyanate to provide a prepolymer, the latter then being cured with a diamine chain extender such as MOCA (4,4'-methylene-bis (2 chloroaniline)) to provide the ultimate polymer. A preform of the polyurethane is molded over the bowling pin core under heat and pressure. U.S. Pat. No. 3,717,344 to Joseph Infantino (AMF Incorporated) discloses a bowling pin having a preformed wood core encased in polyurethane such as aforedescribed and having a de-adhering coating on the core which significantly reduces the incidence of product life-shortening bump or blister formation to which the polyurethane coatings are otherwise prone.

These and other plastic-coated pins such as are currently in use typically require a "break-in" period before their consistent scoring potential is fully realized. The break-in period can range from several score to several hundred games before a relatively high level of scoreability is consistently achieved. Accordingly, there has heretofore existed a need for a plastic-coated bowling pin which requires little or no break-in period and at the same time, retains the neat appearance and durable service characteristics for which resin clad bowling pins are widely noted.

SUMMARY OF THE INVENTION

It has very surprisingly been discovered that bowling pins having wood cores clad with ionomer resin not only possess rugged serviceability and reduced maintenance needs, but require little if any break-in period before consistent scoreability can be attained.

Broadly stated, the bowling pin of this invention comprises a preformed wood core encased in a plastic cladding comprising a resinous layer composed of an ionomer resin.

The term 'ionomer resin' as used herein defines an ionic copolymer of at least 50 mol percent of a monoethylenically unsaturated alpha-olefin of from 2 to 10 carbon atoms, from about 0.2 to about 25 mol percent of an alpha, beta-ethylenically unsaturated carboxylic acid having from 3 to 8 carbon atoms, and optionally, other monoethylenically unsaturated comonomers, said copolymers having from 10% to 90% of the carboxylic acid groups in salt form with metal ions, uniformly distributed throughout the copolymer.

The foregoing copolymers and methods for their preparation are now well-known, as disclosed in U.S. Pat. No. 3,264,272, which is incorporated by reference herein, and are commercially available from E. I. du-Pont de Nemours and Company as the Surlyn ionomer resins. Although ionomer resins and blends of these and other compatible thermoplastic materials have been previously employed in the composition of golf balls (e.g., U.S. Pat. Nos. 3,384,612; 3,421,766; 3,454,280; 3,454,676; and, 3,819,768) and glass bottle coverings, no attempt has heretofore been made to adapt these resins to the construction of a bowling pin or claddings therefor.

The general method of manufacturing the bowling pins of this invention, i.e., twin sheet rotary thermoforming, and the finishing steps including that of applying a top coat as well as the machinery for such manufacturing, are well-known and conventional (e.g., U.S. Pat. Nos. 3,537,138; 3,583,036; 3,787,158; 3,867,088; and 3,868,209, each of which is incorporated by reference herein).

DESCRIPTION OF THE PREFERRED EMBODIMENTS

In the accompanying drawings, FIG. 1 is a vertical elevational view, partly in section, of a bowling pin having a wood core which, in accordance with the invention, is clad with ionomer resin.

Figure 1:
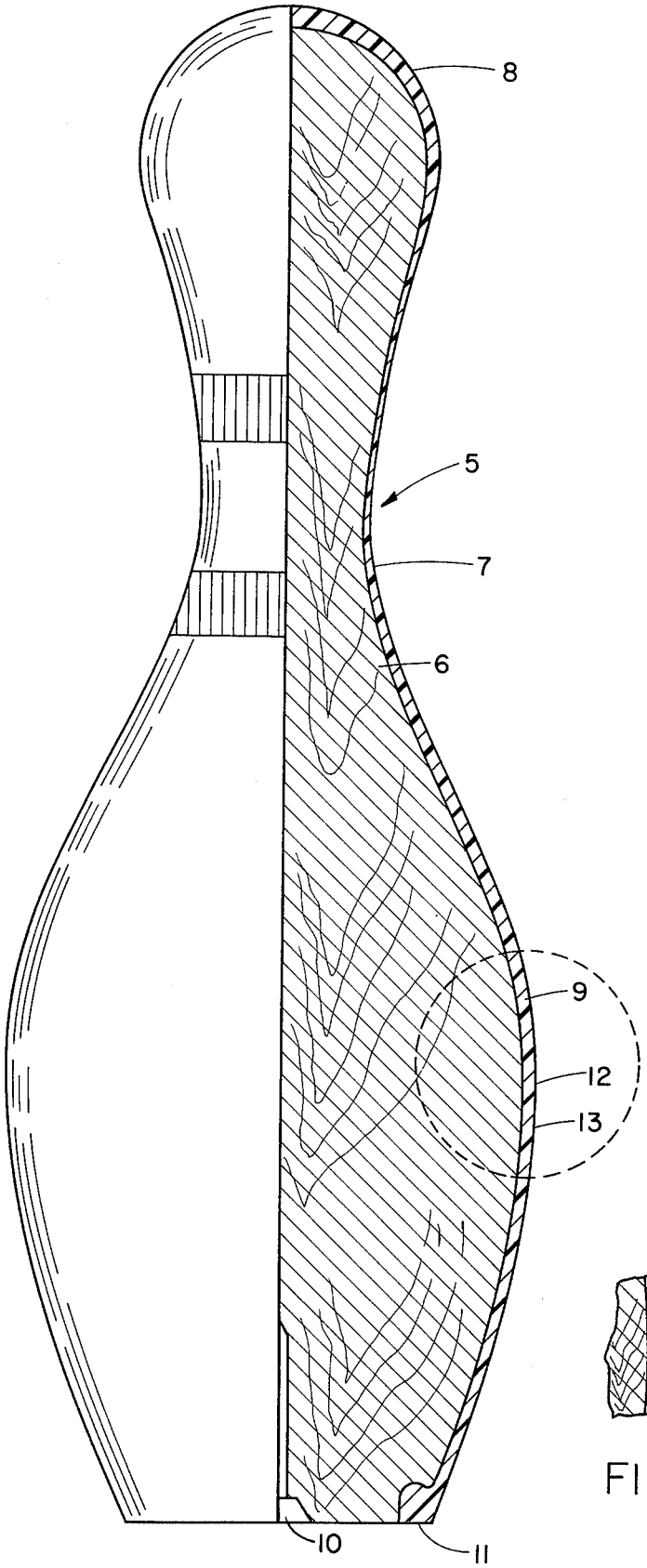
Figure 2:
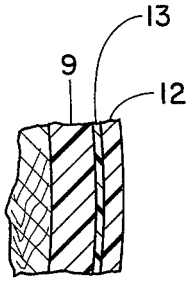
FIG. 2 is a fragmentary detail of the encircled portion of FIG. 1 shown on an enlarged scale.

In the embodiment illustrated in FIG. 1, the pin 5 comprises a wood core 6 of maple or other hardwood encased with a cladding or cover 7 of ionomer resin the composition of which is hereinafter more fully described.

Figure 3:
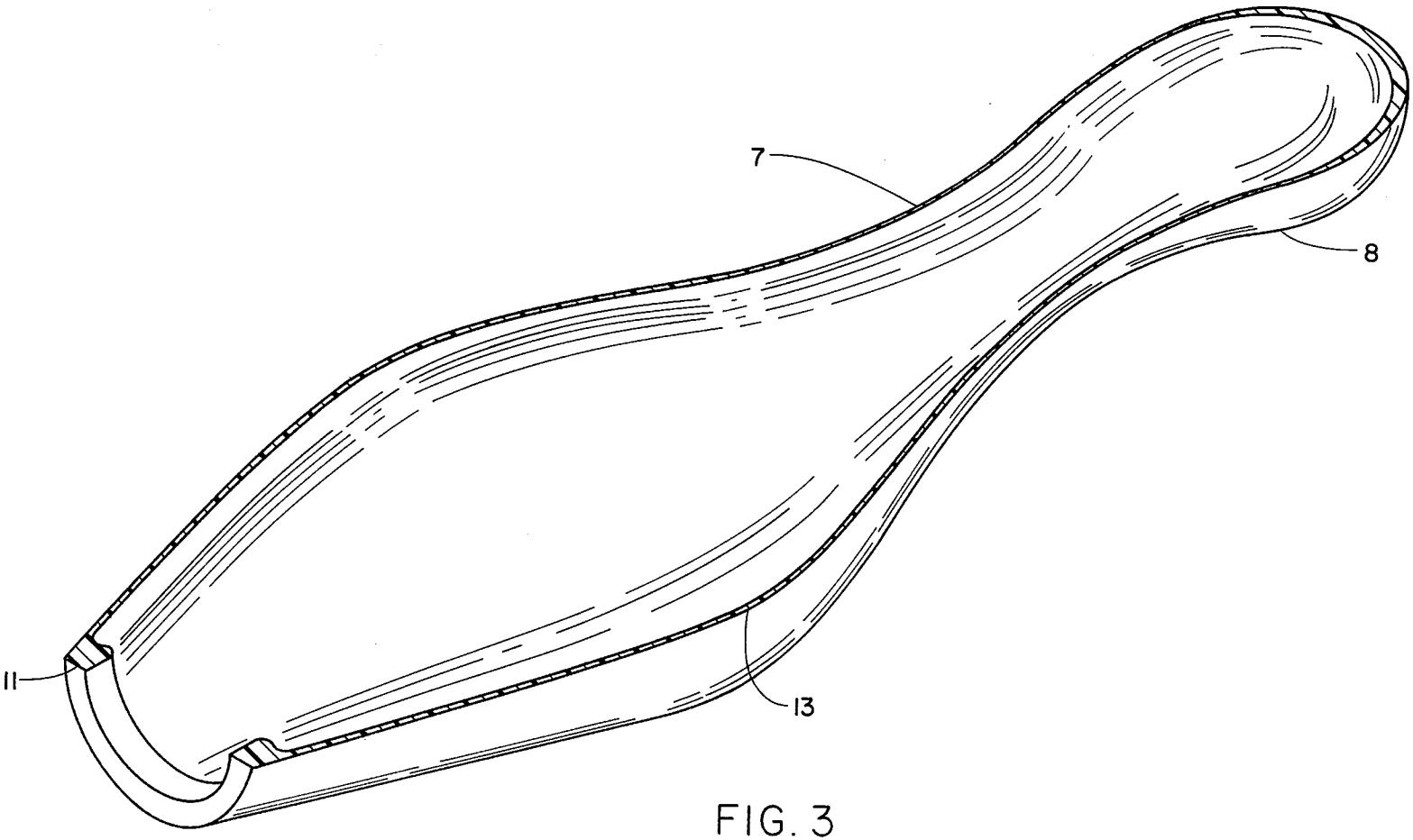
FIG. 3 is a perspective view of the injection molded preform.
Figure 4:
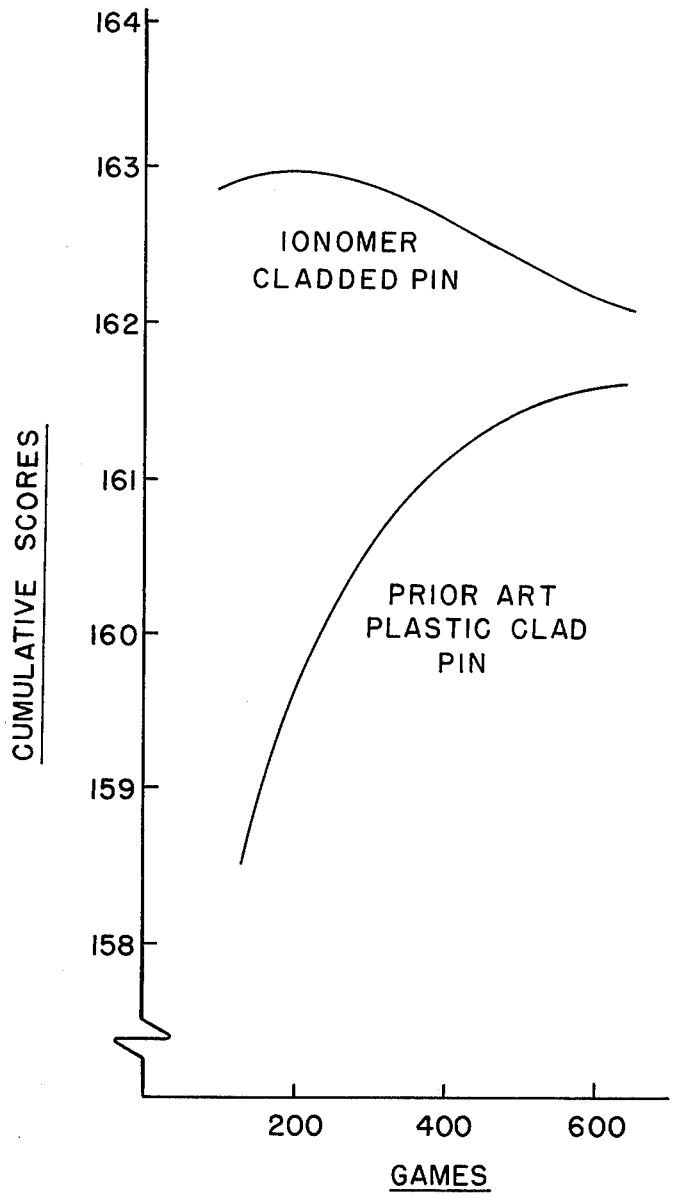
FIG. 4 is a graph of the break-in performance of the cladded pin of the present invention compared to a prior art plastic coated pin.

The cladding preform illustrated in FIG. 3 is injection molded as a hollow structure shaped to conform to the exterior wall of a half-section of a bowling pin. The ionomer resin preform affords bowling pin claddings having low thickness variation e.g., as little as ±10%. The preform may however be of uniform or non-uniform thickness as appropriate to the cladding operation in which the preform halves are mated about and bonded to the wood core. A minimum overall thickness of the cladding of 75 to 80 mils is preferable to minimize later blistering of the ionomer resin coatings when the pins are put into play. If desired, the resin layer can be contoured so that a thicker layer is formed at the head and belly regions, 8 and 9, respectively, where abuse and wear is most severe. The pin is provided with a conventional dowel support recess 10. The base of the pin can be molded as an integral part of the cladding as shown at 11.

When it is desired to utilize a top coat for added soil repellency, intensity of color or durability in use, the ionomer resin cladding can be provided with a top coat 12, e.g., a clear, moisture-cured polyurethane film which utilizes an appropriate solvent system to promote adhesion. A prime coat 13 of a suitable resin, for example, an amine-cured epoxy resin, may also be interposed between ionomer resin cladding 9 and top coat 12 to enhance adhesion of the three layers to each other.

The ionomer resin coatings of this invention can be obtained by copolymerizing a monoethylenically unsaturated alpha-olefin of from 2 to 10 carbon atoms and an alpha, betaethylenically unsaturated carboxylic acid of from 3 to 8 carbon atoms to provide a copolymer containing at least 50 mol percent polymerized alpha-olefin and from 0.2 to 25 mol percent polymerized alpha-beta ethylenically unsaturated carboxylic acid in random distribution and thereafter reacting the copolymers with an ionizable metal compound which results in a form of crosslinking.

Monoethylenically unsaturated alpha-olefins which can be employed in the formation of the ionomer resins include ethylene, propylene, butene-1, pentene-1, hexene-1, heptene-1, 3-methylbutene-1, 4-methylpentene-1, and so on. Among the alpha, beta-ethylenically unsaturated carboxylic acids which can be reacted with the alpha-olefins to form the non-crosslinked copolymers include acrylic acid, methacrylic acid, ethacrylic acid, itaconic acid, maleic acid, fumaric acid monoesters of dicarboxylic acids such as methyl hydrogen maleate, methyl hydrogen fumarate and ethyl hydrogen fumarate and the chemically equivalent acid anhydrides such as maleic anhydride.

Metal ions which are advantageously employed in the formation of the ionically crosslinked copolymers can be selected from among the uncomplexed and complexed ions, as described in U.S. Pat. No. 3,264,272, incorporated herein by reference for the disclosure of suitable metal ions. Examples of useful uncomplexed metal ions are the mono-, di- and trivalent ions of the metals of Groups I, II, III, IV-A and VIII of the Periodic Table of the Elements. Suitable monovalent metal ions are those of sodium, potassium, lithium, cesium, silver, mercury and copper. Suitable divalent metal ions are those of beryllium, magnesium, calcium, strontium, barium, copper, cadmium, mercury, tin, lead, iron, cobalt, nickel and zinc. Suitable trivalent metal ions are those of aluminum, selenium, iron and yttrium. Alkali metal ions are preferred. The crosslinking reaction is preferably carried out by blending the copolymer bases with a sufficient amount of a solution of crosslinking metal compounds calculated to result in neutralization of at least 10 percent of the carboxylic acid groups present in the copolymer chain and separating the resulting crosslinked copolymer.

While numerous ionomer resins can be employed in this invention with good results, the preferred ionomer resins comprise copolymers of ethylene and methacrylic acid, particularly the sodium form, having a melt flow of between about 0.5 and 5.0 g/10 min (ASTM D-1238 (Cond E) and a flex modulus of between about 40,000 and 60,000 psi (ASTM D-790A). Best results have been achieved with Surlyn 1707, an ionic copolymer of approximately 96.5 mole percent ethylene and 3.5 mole-percent methacrylic acid having sodium ions uniformly distributed throughout the copolymer in sufficient amount to effect 50% neutralization of the methacrylic acid. The physical properties of surlyn 1707 are as follows:

| Property | Method | Value |
|---|---|---|
| Melt flow, decigm/min. | ASTM D-1238 (Cond E) | 0.9 |
| Specific gravity, gms/cc. | ASTM D-792 | 0.950 |
| Tensile strength, psi | ASTM D-1708 | 5100 |
| Yield strength, psi | ASTM D-1708 | 2300 |
| Elongation % | ASTM D-1708 | 346 |
| Flex modulus, psi | ASTM D-790A | 55,290 |
| Hardness, Shore D | ASTM D-2240 | 68 |

Top coats can be applied to bowling pins to impart dirt resistance and to protect the pin markings and any logos thereon. Top coats are typically applied in thickness ranging from about 0.0005 to about 0.005 in. but usually from 0.0008 to 0.002 in.

It is necessary that top coats be sufficiently hard to resist dirt and yet sufficiently soft so as not to crack when impacted. For the relatively soft ionomer resin claddings of this invention, the top coat must exhibit a flex modulus matched to the ionomer resin and therefore must be softer than those used on the relatively rigid ethyl cellulose resin claddings of conventional bowling pins. For example, it has been found that nitrocellulose which has been used for years as a bowling pin top coat, cracks within a few games of play when used on an ionomer resin clad bowling pin. It has been further observed that the more rigid polyurethanes, sometimes used as bowling pin top coats, also crack when employed over ionomer resin cladding. Soft polyurethane coatings such as those used on golf balls exhibit intolerable dirt pickup when used on bowling pins and are therefore undesirable.

One top coat having the proper balance of properties is Hughson's Chemglaze V-001, an aliphatic, non-yellowing, semi-rigid glossy polyurethane. The resin cures upon reaction with atmospheric water to a film having the following properties:

| Property | Value |
|---|---|
| Sward Hardness | 60–72 |
| Tensile strength, psi | 4500–5500 |
| Elongation at break | 60 |

Another top coat which has been successfully used over ionomer resin clad bowling pins is Isicoat 3X (Isis Chemical Co.)

Approximate physical properties of the cured Isicoat 3X film are:

| Property | Value |
|---|---|
| Sward Hardness | 60–72 |
| Tensile strength, psi | 4500–5500 |
| Elongation at break | 60 |

In general, for associative use with the ionomer resin cladding, the top coat should exhibit a flex modulus value of within about 25% of the base resin.

It is generally advantageous to apply a prime coat to the surface of the ionomer resin clad bowling pins preparatory to top coating and for this purpose, epoxy resins admixed with polyamide-amines in sufficient concentration in a solvent to achieve a coating on the ionomer resin of about 0.1 mil to about 1 mil. are especially well suited.

A wide variety of epoxy resins can be employed in the primer system. Moreover, these epoxy resins can be aromatic or aliphatic epoxide types and have a molecular weight range from about 300 to about 2,000. Generally the aromatic polyether polyepoxides are the reaction products of bisphenol A and epichlorohydrin and have the general formula

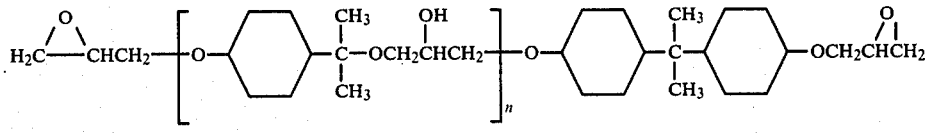

wherein n is an integer from 0 to 7 inclusive. The aliphatic polyether polyepoxides are the reaction products of aliphatic glycols and epichlorohydrin and have the general formula

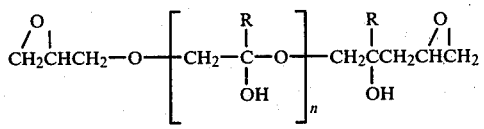

wherein R is selected from the group consisting of lower alkyl radicals containing from 1 to 5 carbon atoms and n is an integer from 3 to 6 inclusive.

One example of an epoxy resin which can be used herein is Shell Chemical Co.'s liquid epoxy resin having an epoxide equivalent of 180–195 by ASTM D-1652-59T, an average molecular weight of 380, a hydroxyl content of 0.06, a density of 1.168 gm/cc., a viscosity at 25° C. of 10,000 to 16,000 cps by ASTM D445-53T and described in Shell Chemical Co.'s Product Specification SC: 60-146.

Illustrative of suitable curing agents within the above categories are materials such as: primary and secondary aliphatic amines, e.g., diethylenetriamine, ethylenediamine, triethylenetetramine, tetraethylenepentamine; hydroxyaliphatic amines, e.g., N-(hydroxyethyl) diethylenetriamine and N,N-bis (hydroxyethyl) diethylenetriamine; polyalkylene polyamines; acrylonitrile-acrylamide copolymers; acrylonitrile-amine adducts, e.g., cyanoethyldiethylenetriamine; aliphatic amine adducts, e.g., an adduct of liquid epoxy resin with an excess of polyamine and phenyl tertiary amines, e.g., tri-(dimethylaminomethyl) phenol.

The preferred curing agents, however, are those which impart a high degree of flexibility to the cured primer layer and therefore optimize the adhesion of the ionomer resin and the top coat to the primer. Such curing agents are generally known as polyamide-amines which the Versamids (General Mills Inc.) are illustrative. The Versamids are derived from the reaction product of dimerized linoleic acid with di- or polyamines and are described in U.S. Pat. No. 2,379,413. They have the general structure: $HO(—OCRONH—R'—NH)_nH$. R,R' and n will vary depending on the grade of Versamid. One example of a suitable polyamide for use herein is Versamid 140 having the following properties:

| Property | Value |
|---|---|
| Amine value | 350–400 |
| Viscosity @ 25° C., poises | 125–175 |
| Specific gravity, g/cc. | 0.97 |

The solvent system for the epoxy-polyamide usually consists of blends of aromatic hydrocarbons, esters, ketones and alcohols depending on the drying rate desired and the method of application. Concentration of the epoxy-polyamide in said solvent blend is in the range 1 to 15% but typically can vary from 2.5 to 8%.

The following example is illustrative of a bowling pin having an ionomer resin cladding in accordance with this invention.

EXAMPLE

A sufficient quantity of ionomer resin pellets (Surlyn 1707) is blended with about 2 percent by weight of titanium dioxide pigment and injection molded to provide matching pre-forms approximately corresponding to the exterior configuration of one half of the bowling pin viewed lengthwise. A precisely contoured maple wood core is placed sandwich fashion between a pair of pre-forms which, if desired, can be preheated and the initial assembly is placed in a cored aluminum thermoforming mold provided with passages for a heating fluid (steam at 100 to 120 psig) and a heat exchange fluid (water at 38° to 60° F.). The pre-forms are compression molded about the wood core under a force of from 10 to 45 tons and at a temperature of 300° to 350° F. The resin-enclosed core is cooled to below about 120° F., taken from the mold, de-flashed, scrubbed with trichlorethane for about 4 to 5 seconds to remove any mold release agent and striped and marked with a two component epoxy paint.

The paint is allowed to dry overnight at 100° F. and 50% relative humidity. The pin is then flame treated by rotating at 2–3 rotations per second in contact with the oxidating portion of the gas flame for 2 to 4 seconds. An epoxy prime coat of approximately 0.1 mil is then applied by dip or flow coating. The pin is then given a flow coat of sensitizer (quaternary ammonium compound in hexane). A clear polyurethane top coat is electrostatically sprayed on the pin to a uniform thickness of about 1 mil, and the pin is advanced to the flash-off section of the drier where it is exposed to 100° F. and 20% relative humidity for 15 minutes. After flash-off, the top coat is partially cured at 100° F. and 50% RH for 1 hour. The pin is then grooved, undercut, provided with nylon bases and sorted with other pins of like weight. Finally, the pin is stored for two weeks at ambient conditions to effect complete cure of the polyurethane top coat.

Even after some 9,000 test games, bowling pins manufactured in accordance with this invention remained in excellent playing condition. Test games comparing ionomer resin-coated pins with pins of standard or conventional construction e.g., having an ethylcellulose dipped coating (AMF Chemweld pin) also demonstrated a significant difference in scoring patterns between the two types. The ionomer resin-coated pin consistently scored better than the standard pin for about the first 600 test games and only in later games did their cumulative scoring patterns become comparable, with the ionomer clad pins evidencing scoring about 0.62 pins higher than the standard pin after 1200 games.

Yet another advantage enjoyed by the bowling pins of this invention lies in the crisp ringing sound which they give upon impact with a bowling ball. Although the perception of this advantage is largely psychological, experienced bowlers associate such a sound with a bowling pin in top playing condition.

What is claimed is:

1. A bowling pin comprising a wood core encased in a plastic cladding composition comprising a resinous layer composed of an ionomer resin, said pin having improved break-in performance, exhibiting in use a relatively high initial scoring level.

2. The bowling pin of claim 1 having a maple wood core.

3. The bowling pin of claim 1 having a top coat adhered to the ionomer resin.

4. The bowling pin of claim 3 wherein the top coat is a moisture cured polyurethane.

5. The bowling pin of claim 1 having a thicker layer of cladding at the head and belly regions.

6. The bowling pin of claim 1 wherein the ionomer resin is made by salt-forming with metal ions at least 30% of the acid groups of a copolymer of units derived from an alpha-olefin of the formula $RCH{=}CH_2$ wherein R is H or alkyl having from 1–8 carbon atoms and from 1.0 to 25 mole percent of units derived from an $\alpha,\beta$-ethylenically unsaturated carboxylic acid selected from the class of $\alpha,\beta$-ethylenically unsaturated carboxylic acids consisting of acrylic acid, methacrylic acid, maleic acid, fumaric acid, monoalkyl maleate esters, monoalkyl fumarate esters, maleic anhydride and fumaric anhydride.

7. The bowling pin of claim 6 wherein said $\alpha$-olefin is ethylene.

8. The bowling pin of claim 7 wherein said carboxylic acid is methacrylic acid.

9. The bowling pin of claim 8 wherein said ionomer resin has a melt flow of between about 0.5 and 5.0 g/10 min. and a flex modulus of between about 40,000 and 60,000 psi.

10. The bowling pin of claim 1, wherein said cladding has a thickness of at least 75 mils and a thickness variability over the surface of ±5 mils.

* * * * *